US007878333B1

(12) United States Patent
Necessary

(10) Patent No.: US 7,878,333 B1
(45) Date of Patent: Feb. 1, 2011

(54) ACCESSORY STORAGE AND DECORATIVE DISPLAYING DEVICE

(76) Inventor: Maria Lynn Necessary, 247 Silver Ridge Dr., Dallas, GA (US) 30157

( * ) Notice: Subject to any disclaimer, the term of this patent is extended or adjusted under 35 U.S.C. 154(b) by 0 days.

(21) Appl. No.: 12/661,332

(22) Filed: Mar. 15, 2010

Related U.S. Application Data

(60) Provisional application No. 61/211,291, filed on Mar. 27, 2009.

(51) Int. Cl.
*A45C 11/16* (2006.01)
*A47F 5/00* (2006.01)

(52) U.S. Cl. ..... 206/747; 206/6.1; 206/457

(58) Field of Classification Search ..... 206/745, 206/747, 577, 45.24, 6.1, 566, 457; 211/85.2
See application file for complete search history.

(56) References Cited

U.S. PATENT DOCUMENTS 3,792,507 A * 2/1974 Szabrak et al. ..... 15/268
5,090,569 A * 2/1992 Nissen et al. ..... 206/457
5,692,601 A * 12/1997 Moss ..... 206/6.1
6,041,918 A * 3/2000 Moore ..... 206/0.815
7,202,484 B1 * 4/2007 Tantillo ..... 250/455.11
7,735,639 B1 * 6/2010 De Mare ..... 206/5
2004/0129582 A1 * 7/2004 Cutler ..... 206/232
2009/0065373 A1 * 3/2009 Kornowski ..... 206/6.1

* cited by examiner

*Primary Examiner*—Jacob K Ackun, Jr.
(74) *Attorney, Agent, or Firm*—Robert Z. Evora

(57) ABSTRACT

A decorative accessory storage device including a container, a shaft, a stand, and a panel for positioning, and displaying an accessory. The container of the accessory storage device includes a first container portion and a second container portion connected together at a closing edge. The shaft has a first end received by a sleeve attached to the container, and a second end disposed within an aperture in a stand being adapted to position the container in an upright position. A panel including a perforation is disposed in the container on to which a fastener of an accessory may be attached to position the accessory in a predefined position within the container.

8 Claims, 11 Drawing Sheets

FIG. 22
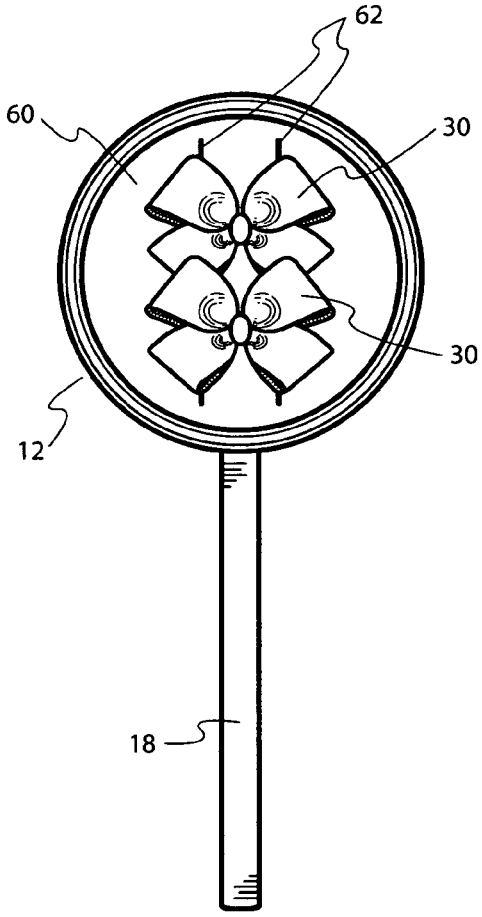
FIG. 23
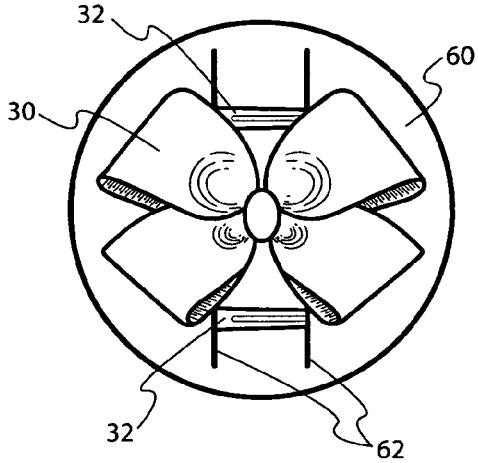
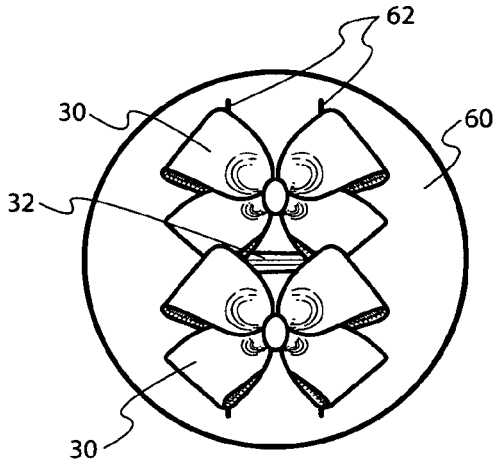
FIG. 24

ACCESSORY STORAGE AND DECORATIVE DISPLAYING DEVICE

CROSS REFERENCE TO RELATED APPLICATION

This application is a Non-Provisional Application which claims the benefit of the filing date of U.S. Provisional Application Ser. No. 61/211,291 entitled "Accessory Storage And Decorative Displaying Device" filed Mar. 27, 2009, the entirety of which is incorporated herein by reference.

BACKGROUND OF THE INVENTION

1. Field of the Invention

This invention relates to an accessory storage and displaying device, and in particular for positioning and displaying various accessory items in an organized and decorative manner.

2. Description of the Related Art

Fashion accessories are typically arranged for purchase in retail outlets on a variety of different display racks. Some accessories are displayed on standing racks, some on hanging racks, and others on horizontal racks, and even further others in a host of other arrangements.

In theory, it would be nice to similarly recreate the tidy appearance of a display-rack for accessories in a retail store at a person's home. However, the reality of purchasing and erecting a cumbersome commercial rack at home is unlikely and invariably unsightly since the entire rack would not be filled with accessories. Inevitably, what commonly occurs is that the various accessories merely get tossed into a drawer with little care. Consequently, delicate accessories may be damaged and/or misplaced never to be found when desired for use. Unfortunately, not only are the accessories hard to locate, but people often forget what accessories they have, particularly those buried at the bottom of the drawer.

Thus, there is a need to provide a convenient way to store and decoratively display accessories in confined spaces, while preserving an ease of access and an aesthetic appearance. In accordance with this invention, an exemplary accessory container device is described and shown below which solves this problem.

SUMMARY OF THE INVENTION

The present invention addresses the shortcomings identified in providing an accessory storage device adapted to store and display an accessory in a decorative manner;

The accessory storage device includes a container constructed of a first container portion and a second container portion connected together at a closing edge. A shaft having a first end and a second end, the first end received by a retaining sleeve attached to the container and adapted to position the container in an upright position. The accessory storage device includes a stand having side walls bounded by a flat base and a top. The top has a recessed aperture adapted to receive the second end of the shaft in order to position the container is an upright position on top of the stand. The accessory storage device further includes a panel including perforations through which a fastener of an accessory may be attached to position the accessory in a predefined position within the container.

Various accessories may be placed within the container, including but not limited to at least one of: a bow clip, jewelry, a beret, a head band and a hair band. The container may be configured to resemble one of any number of various shapes, including but not limited to, at least one of: a lollipop; a heart; a character, a logo, a mascot, and/or any other shape in accordance with this invention.

These and other objects, features, and/or advantages may accrue from various aspects of embodiments of the present invention, as described in more detail below.

BRIEF DESCRIPTION OF THE DRAWINGS

Various exemplary embodiments of this invention will be described in detail, wherein like reference numerals refer to identical or similar components or steps, with reference to the following figures, wherein:

FIG. 22 illustrates a pair of bow clips attached to the panel disposed within the container in accordance with this invention.

FIG. 23 is a front view of the panel including a bow clip and a pair of bow clip fasteners attached thereon in accordance with this invention.

FIG. 24 depicts a rear view of the panel shown in FIG. 23 depicting the pair of bow clips and a bow clip fastener for the bow clip attached to the front side of the panel in accordance with this invention.

DETAILED DESCRIPTION OF EXEMPLARY EMBODIMENTS

Particular embodiments of the present invention will now be described in greater detail with reference to the figures.

Figure 1:
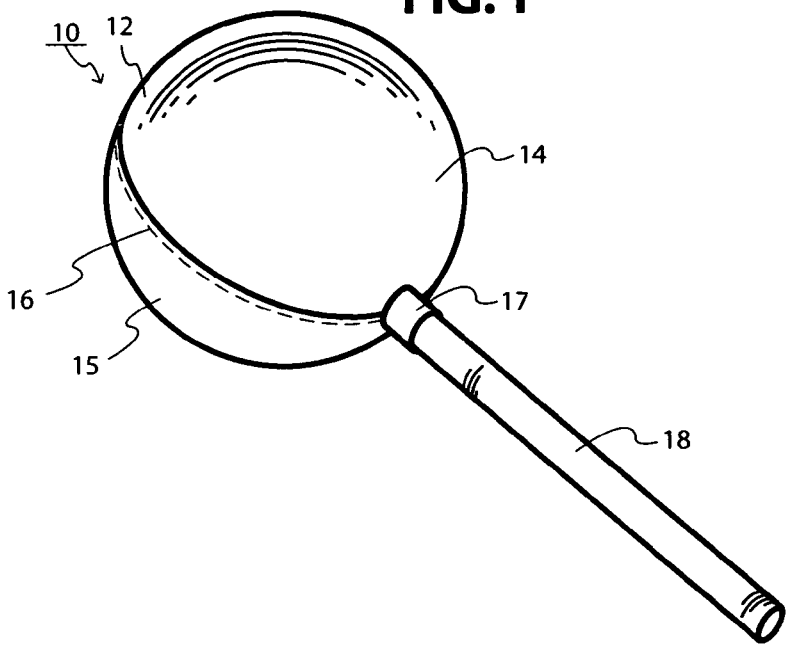
FIG. 1 illustrates a perspective view of an exemplary accessory storage device in accordance with this invention.
Figure 2:
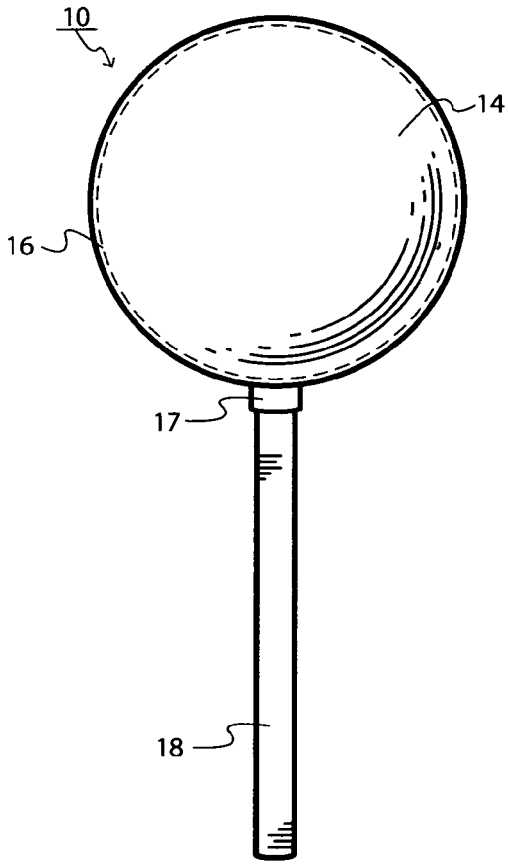
FIG. 2 depicts a front view of the exemplary accessory storage device in accordance with this invention.

FIGS. 1 and 2 show an exemplary embodiment of the accessory storage device 10. The accessory storage device 10 is adapted to hold and display a variety of accessories, such as for example but not limited to, bow clips, jewelry, berets, head bands, scrunchies, banana clips, hair crimping type accessories, ponytail holders, rings, earrings, necklaces, scarves, and the like.

The accessory storage device 10 includes a container 12 connected by a retainer 17 to a shaft 18. As shown in FIG. 1, the accessory storage device 10 is configured to resemble a lollipop. Although shown as a lollipop, it is to be understood that the accessory storage device 10 may take any number of various shapes and sizes in accordance with this invention.

The container 12 portion includes a first container portion 14 and a second container portion 15 defining an encapsulated volume within the container 12. The first container portion 14 and the second container portion 15 are assembled in a clam shell-like configuration and may be connected at a closing edge 16. That is, the container 12 may be assembled so that at least one connection point, such as a hinge, or pivot connection, is provided to keep the first container portion 14 and the second container portion 15 connected when the container 12 is opened.

Figure 4:
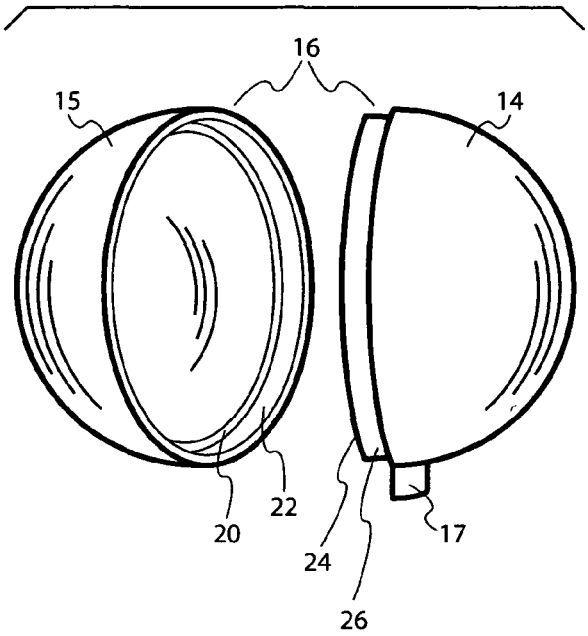
FIG. 4 depicts an exemplary illustration of an open container in accordance with this invention.
Figure 5:
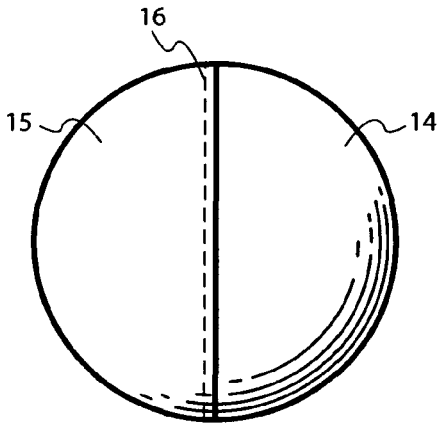
FIG. 5 shows a top view of the accessory storage device in accordance with this invention.

On the contrary, the container 12 may be configured so that first container portion 14 and the second container portion 15 are completely separable from each other when the two parts of the container 12 are opened as shown in FIG. 4. Various types of suitable latching connections are possible in order to secure the container 12 that are within the scope of this invention.

Figure 8:
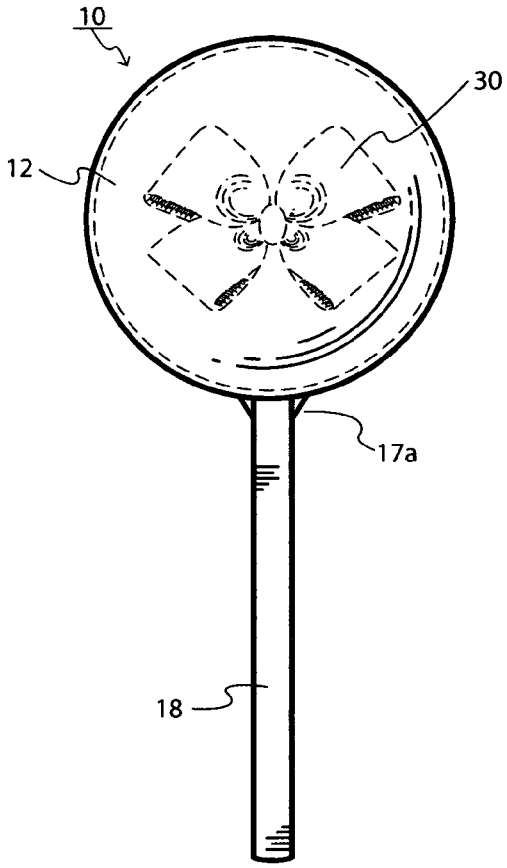
FIG. 8 depicts a front view of the accessory storage device containing an accessory within the container in accordance with this invention.
Figure 9:
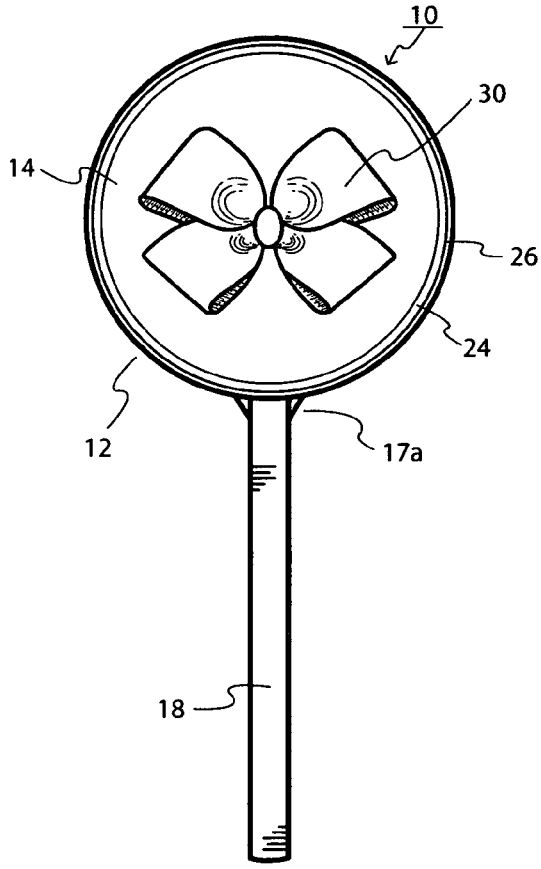
FIG. 9 illustrates an open front view of the accessory storage device with the accessory disposed within the container in accordance with this invention.

In FIG. 2, the retainer 17 is shown as a sleeve-like receptacle into which the shaft 18 is received and secured in place. The shaft 18 may be secured by a plurality of different methods, including but not limited to, a threaded fastener connection, a friction fit, an adhesive, a bond, a weld, fusing, and/or any other type of process for securing the shaft 18 to the retainer 17 and/or directly to the container 12. For example, FIGS. 8 and 9 depict a retaining fill 17*a* between the container 12 and the shaft 18 indicative of a container 12 being secured to the shaft 18 by at least one of: an adhesive, molding, fusing welding and/or the like. In another alternative, the retainer 17 can take a split construction in which a first curved half of the retainer 17 is fastened to the first container portion 14 (as shown in FIG. 4) and a second curved half of the retainer 17 is fastened to the second container portion 15.

Figure 32:
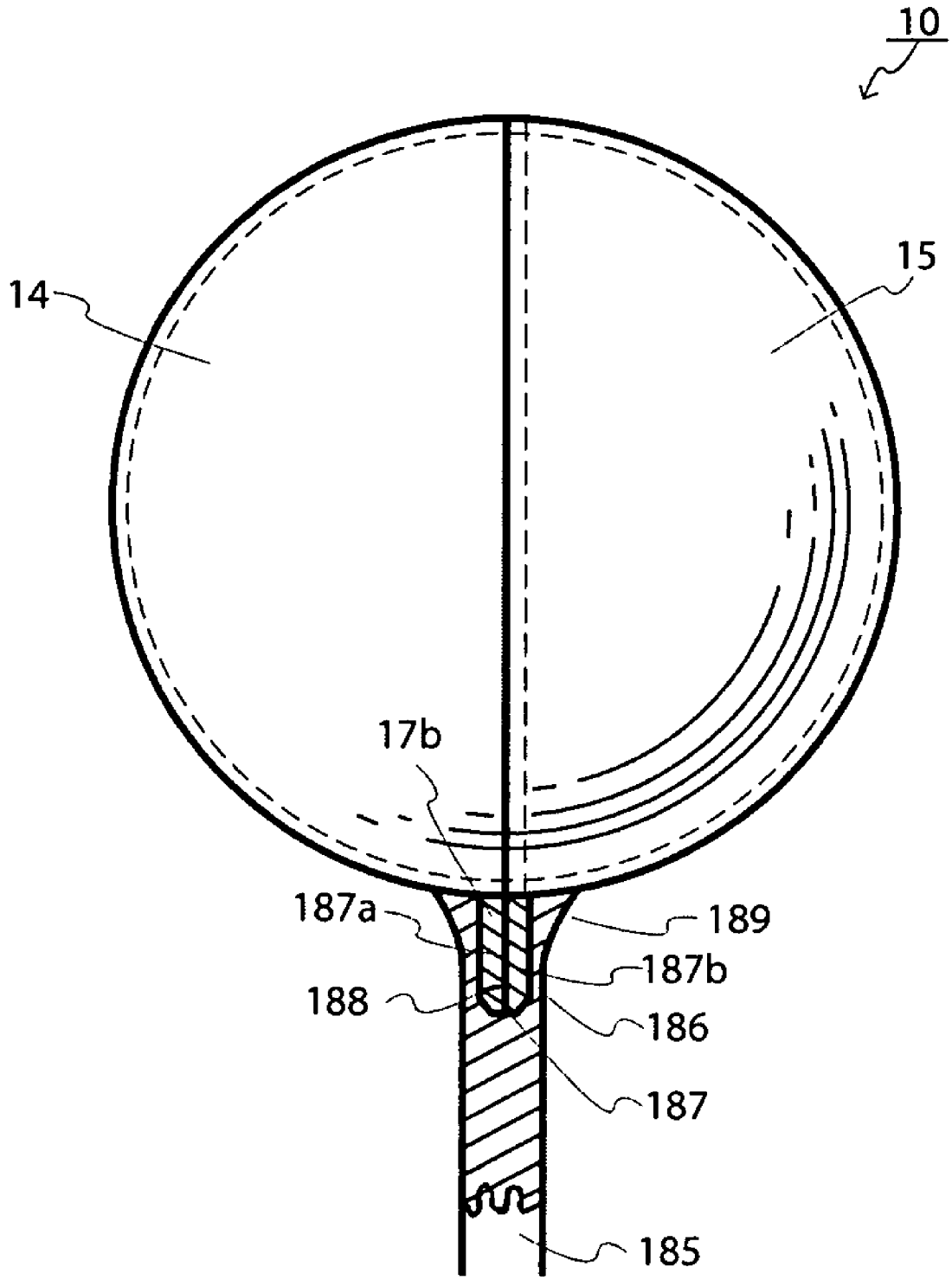
FIG. 32 depicts another exemplary connection between the container and the shaft in accordance with this invention.

FIG. 32 depicts another exemplary embodiment for the accessory storage device 10 in which the container 12 is fastened to a shaft 185 through a threaded fastener connection 17*b*. As shown in assembly, the threaded fastener connection 17*b* is divided into a first male threaded portion 187*a* and a second male threaded portion 187*b*. The first male threaded portion 187*a* is attached to the first container portion 14, and the second male threaded portion 187*b* is attached to the second container portion 15. The first male threaded portion 187*a* and the second male threaded portion 187*b* are aligned next to each other at junction 188 and combined together to form a complete male threaded portion 187. The shaft 185 is flared outward at a first end 189 adjacent to the container 12. An inner female threaded portion 186 is disposed within the flared end of the shaft 185 and is adapted to be received, and fastened to, the male threaded portion 187.

In use, to disassemble and gain access to the inner volume of the container 12, the threaded fastener connection 17*b* is unscrewed from the inner female threaded portion 186. In particular, the inner female threaded portion 186 within the shaft 185 is unscrewed from the male threaded portion 187 by slowly turning the shaft 185 (e.g., in a counter-clockwise direction) until it is disconnected from the male threaded portion 187. Then, the first container portion 14 and the second container portion 15 are pulled apart to open the container 12 and permit access therein.

To re-assemble, both halves of the container 12 are positioned together, and the reverse process is performed. In particular, the male threaded portion 187*a* attached to the first container portion 14, and the second male threaded portion 187*b* attached to the second container portion 15 are aligned and positioned together to form the complete threaded fastened connection 17*b*. The inner female threaded portion 186 within the shaft 185 is then slowly twisted over the threaded fastened connection 17*b* (e.g., in a clockwise direction) until the shaft 185 is seated substantially adjacent a base of the container 12.

Figure 3:
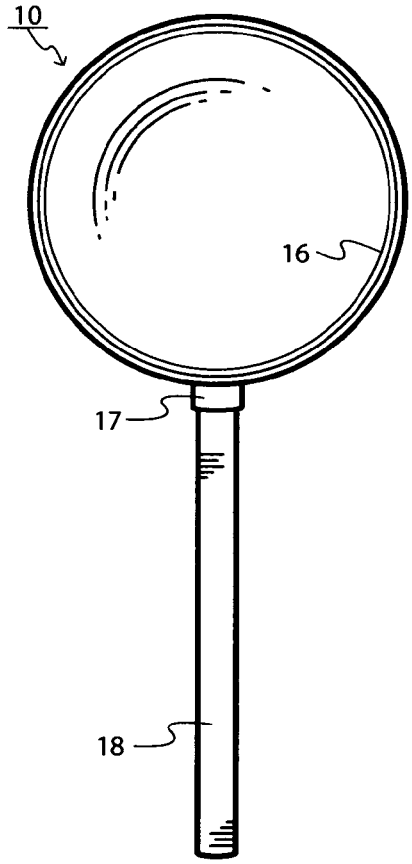
FIG. 3 shows an open front view the first container portion removed depicting an inner view of the container in accordance with this invention.

Referring back to FIGS. 3 through 7 further demonstrate the closing edge 16 connection between the first container portion 14 and the second container portion 15 of the container 12. As illustrated, FIG. 3 shows at least one half of the container 12 being removed depicting the closing edge 16. As shown in FIGS. 4-7, the closing edge 16 of the first container portion 14 includes an outer ridge 24 defined at the end of an inner male concentric flange 26. Likewise, the closing edge 16 of the second container portion 15 includes an inner ridge 20 defined at a base of an outer female concentric flange 22.

In operation, the first container portion 14 is pulled apart from the second container portion 15 of the container 12, as shown in FIG. 4. An accessory 30 is placed within the container 12 and the first container portion 14 is then reconnected with the second container portion 15 of the container 12, as shown in closed position in FIG. 5.

Figure 6:
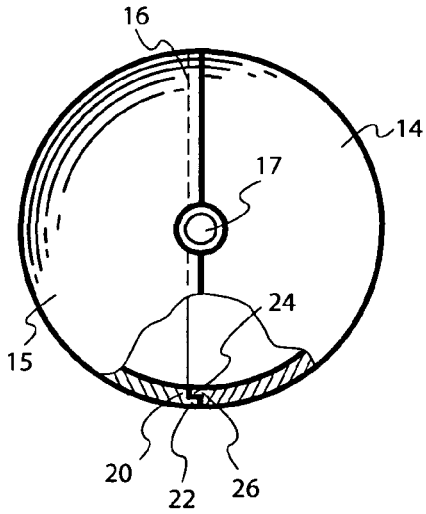
FIG. 6 depicts a bottom cut-away view of the accessory storage device in accordance with this invention.
Figure 7:
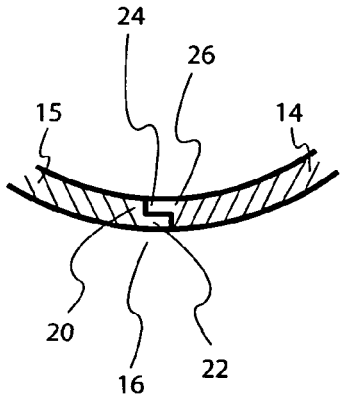
FIG. 7 illustrates an exploded cross-section view of the closing edge connection between the first container portion and the second container portion of the container in accordance with this invention.

As shown in FIGS. 6 and 7, in a closed position, the outer ridge 24 of the first container portion 14 is butt up against, or lies adjacent to, and concentric over the inner ridge 20 of the second container portion 15. Also, the inner male concentric flange 26 of the first container portion 14 is friction fit against the outer female concentric flange 22 of the second container portion 15. Although this friction fit connection is illustrated, it is to be understood that a number of different connections may be implemented in accordance with this invention to allow ingress and egress of an accessory 30 (as shown in FIG. 8) disposed within the container 12.

FIGS. 8 and 9 show an exemplary bow clip 30 accessory being disposed within the container 12 of the accessory storage device 10. In particular, FIG. 8 shows the closed container 12 and the bow clip 30 accessory in hidden lines. FIG. 9 depicts the container 12 open with the bow clip 30 disposed within the container 12. The decorative configuration for the accessory storage device 10 illustrates the bow clip 30 disposed within a lollipop-like configuration for the accessory storage device 10.

Figure 10:
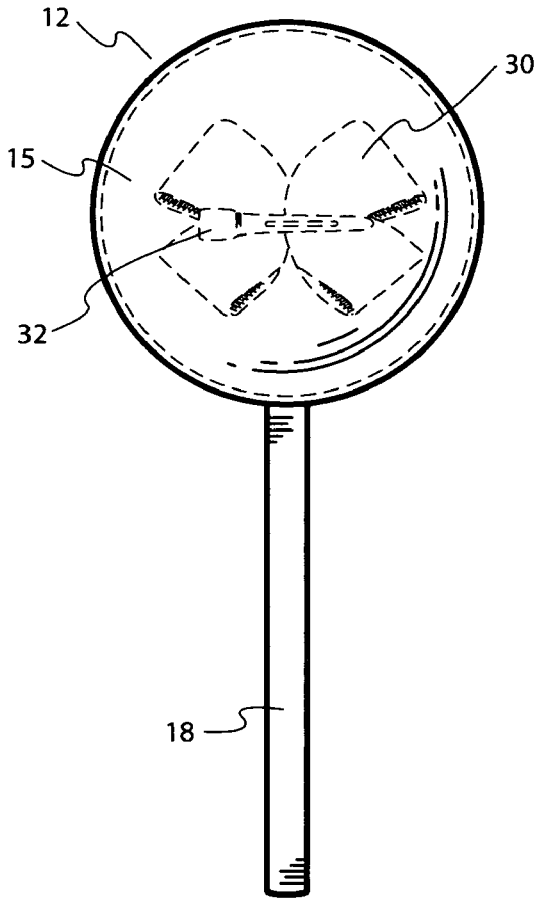
FIG. 10 shows a rear view of the accessory storage device with a back view of the accessory disposed within the container in accordance with this invention.
Figure 11:
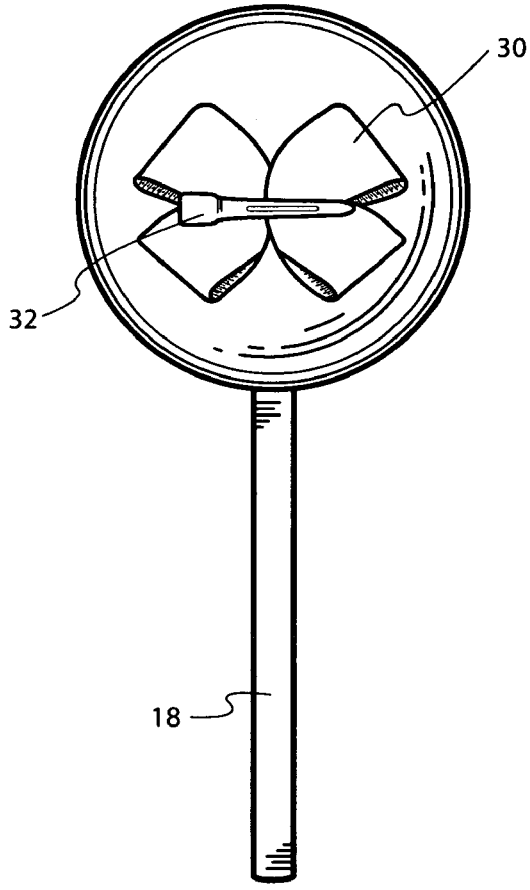
FIG. 11 depicts an open rear view of the container illustrating the rear view of the clip fastener of the accessory disposed in accordance with this invention.

FIGS. 10 and 11 illustrate a rear view of the exemplary bow clip 30 disposed within the container 12. FIG. 10 shows the closed container 12 and the rear view of the bow clip 30 accessory in hidden lines disposed within the closed container 12. Similarly, FIG. 11 shows the bow clip 30 disposed within the open container 12. As shown, a clip fastener 32 may be attached to the rear of the bow clip 30 in order to fasten the bow clip 30 to a lock of hair.

Figure 12:
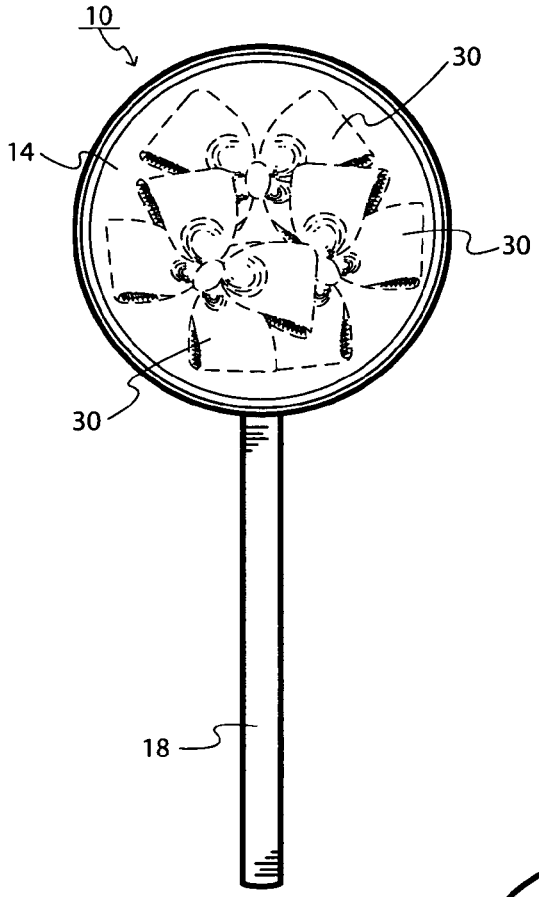
FIG. 12 illustrates a front view of the accessory storage device including a plurality of accessories disposed within the container in accordance with this invention.
Figure 13:
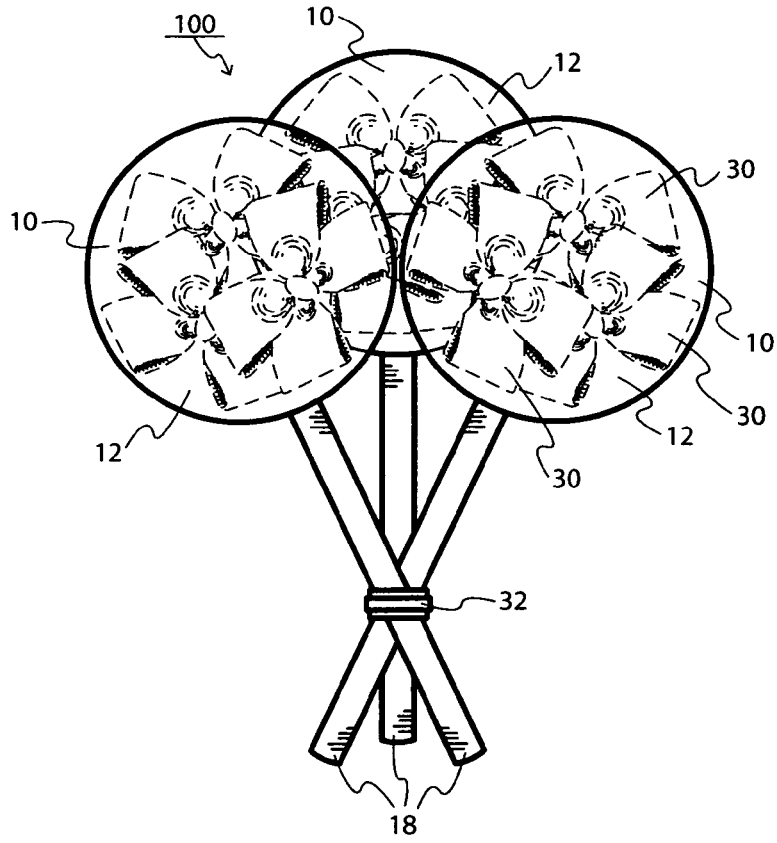
FIG. 13 depicts a bouquet arrangement including a plurality of accessories disposed within each of the various containers in accordance with this invention.
Figure 14:
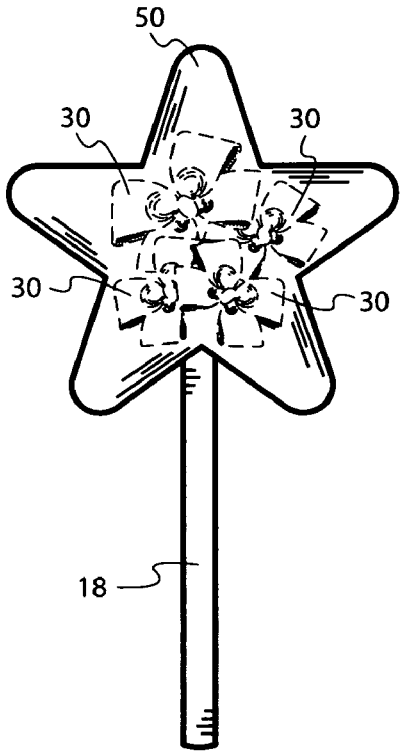
FIG. 14 shows a front view of an accessory storage device including a plurality of accessories in the shape of a star in accordance with this invention.
Figure 15:
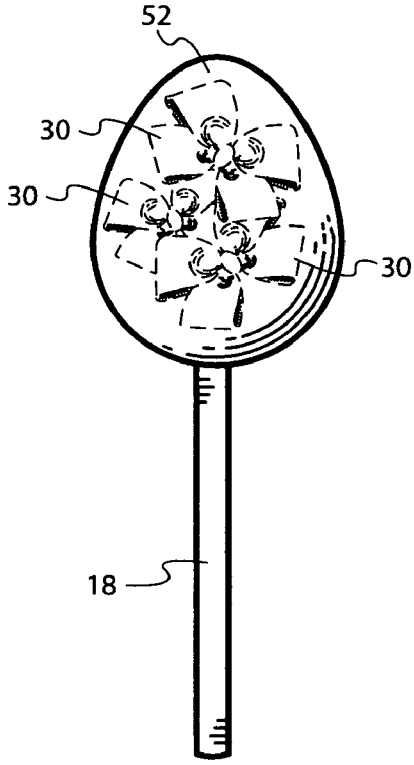
FIG. 15 illustrates a front view of an accessory storage device including a plurality of accessories in the shape of an oval in accordance with this invention.
Figure 16:
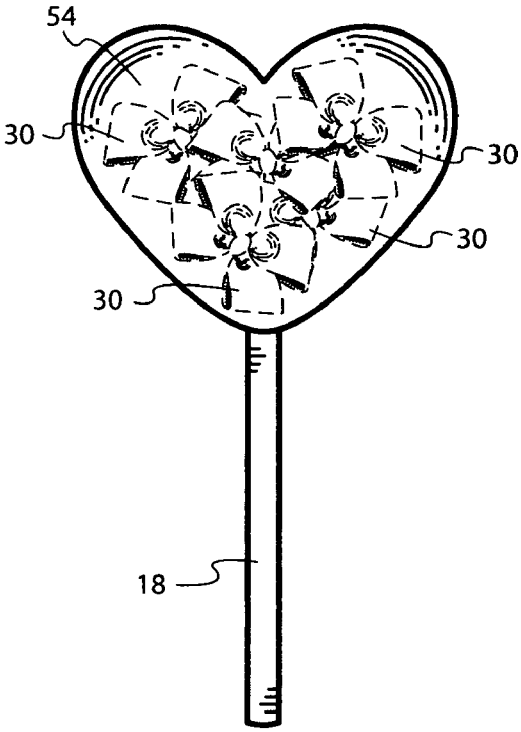
FIG. 16 depicts a front view of an accessory storage device including a plurality of accessories in the shape of a heart in accordance with this invention.

Various configurations for the accessory storage device 10 are possible. For example, FIG. 12 illustrates the inclusion of numerous bow clips 30 arranged within the container 12 of the accessory storage device 10. FIG. 13 further illustrates numerous accessory storage devices 10 combined and secured together by a fastener 32 in the shape of a bouquet arrangement 100. FIGS. 14 through 17 further demonstrate the versatility and the ability to adapt the accessory storage device 10 in variety of different configurations, such as in the shape of a star 50, an oval egg shape 52, a heart shape 54, a candy apple shape 56 and/or any shape in accordance with this invention.

Figure 17:
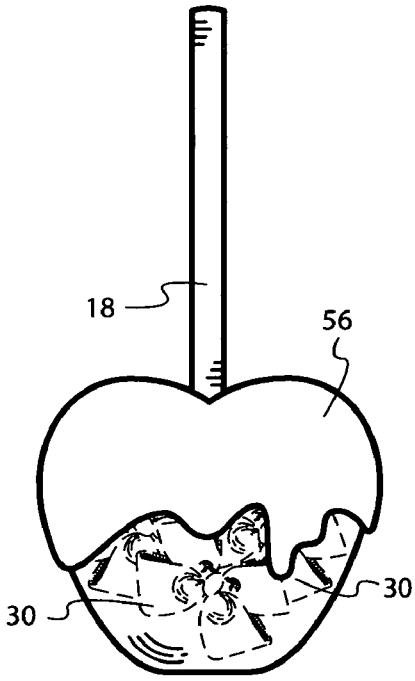
FIG. 17 further illustrates an exemplary view of an accessory storage device including a plurality of accessories in the shape of a candy apple in accordance with this invention.
Figure 18:
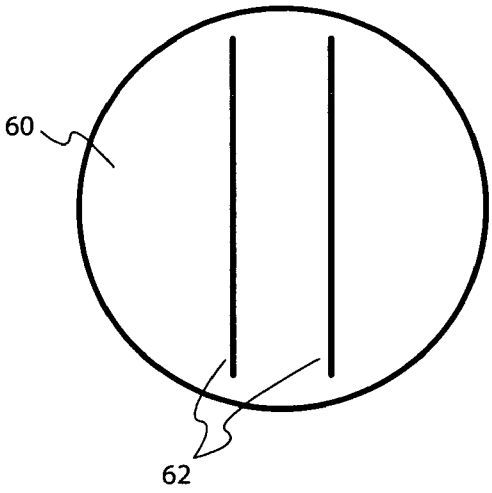
FIGS. 18-20 illustrate a front, a perspective and a side view of the panel in accordance with this invention.
Figure 19:
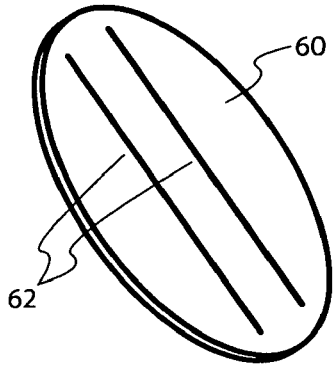
Figure 20:
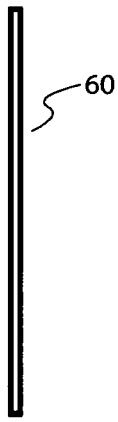
Figure 21:
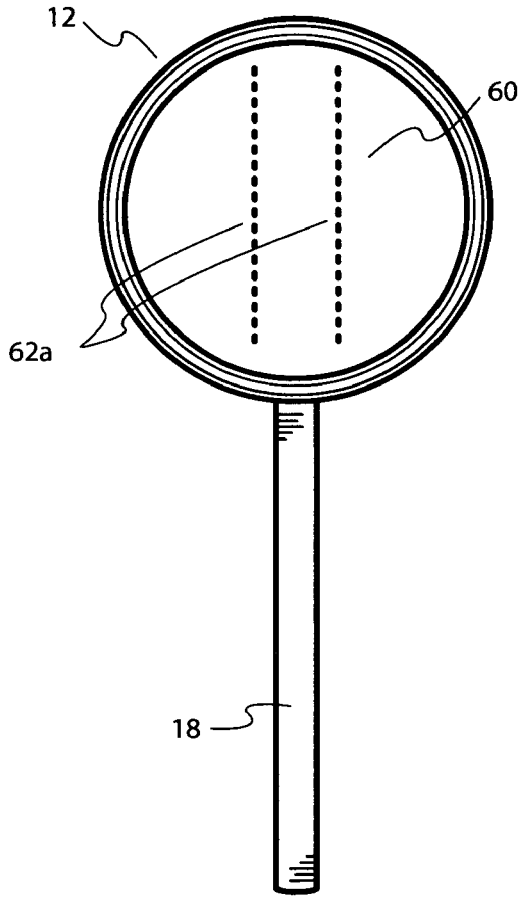
FIG. 21 shows an exemplary positioning of the panel within the accessory storage device in accordance with this invention.

For example, FIG. 17 further illustrates an exemplary view of an accessory storage device 10 functionally being used in an inverted manner. In FIG. 17, the accessory storage device is in the shape of a candy apple 56. The candy apple 56 shaped container includes a plurality of bow clip 30 accessories. A plurality of bow clips 30 are disposed within the container 12 and attached to a panel 60. In this configuration, the shaft 18 extends upward away from the candy shaped 56 container.

FIGS. 18 through 21 illustrates an exemplary panel 60 adapted to secure a bow clip 30 and/or other accessory in a preferred position within the container 12 of the accessory storage device 10. As shown, the panel 60 includes a pair of perforations 62 (and 62*a* un-torn) through which the clip fastener 32 of the bow clip 30 may be fastened in a predefined position within the container 12. The panel 60 may be constructed as a semi-rigid element adapted to fit within the container 12 and to secure the bow clip 30 in any preferred predetermined position. In position, the edges of the panel 60 may be grooved to fit within and/or adjacent to the closing edge 16, and/or any interior portion, of the container 12.

FIGS. 22 through 24 show the panel 60 in operation. In use, the panel 60 may be positioned adjacent to the closing edge 16 and secured into position. At least one bow clip 30 is fastened to the panel 60. In FIG. 22 two bow clips 30 are shown connected to the panel 60. The bow clips 30 are arranged one on top of the other. As shown in FIGS. 23 and 24, the panel 60 may be adapted to arrange numerous bow ties 30 in various decorative arrangements.

In more detail, FIG. 23 shows a front view of the panel 60 including a front view of a first bow clip 30 and a pair of clip fasteners 32 for a pair of bow clips 30 arranged rearward being attached to the back side of the panel 60, as shown in FIG. 24.

Figure 25:
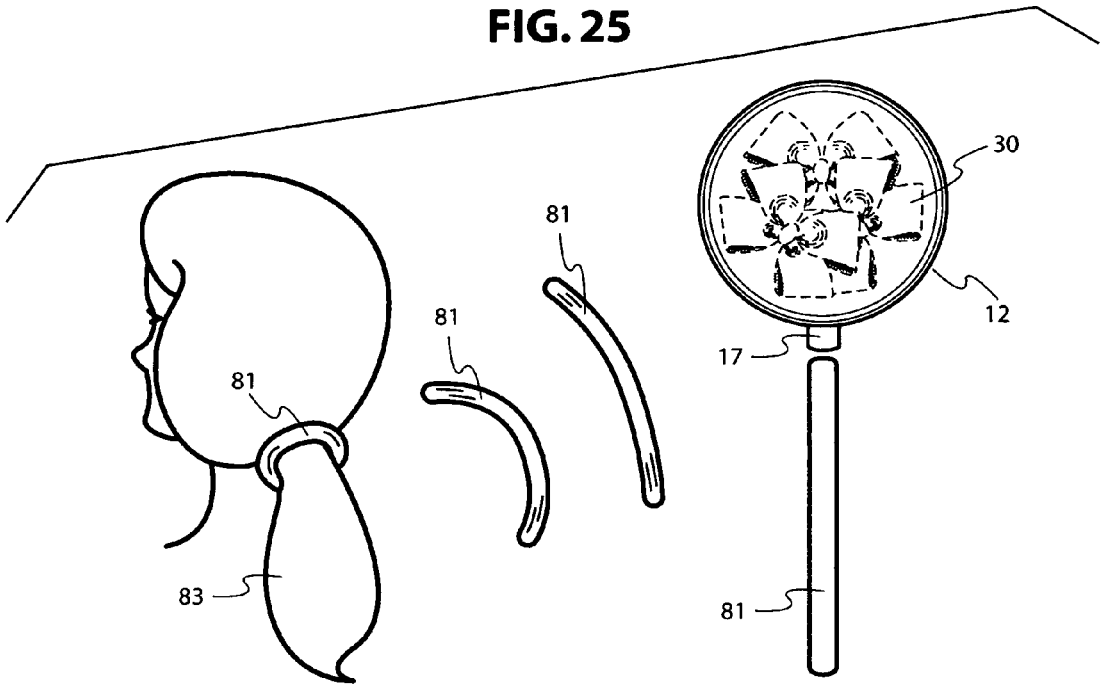
FIG. 25 illustrates an exemplary shaft disconnected from the container and being bent into a preferred configuration adapted to secure a lock of hair into a pony tail in accordance with this invention.

FIG. 25 illustrates another exemplary use for a flexible shaft 81. In accordance with this aspect of the invention, it is also understood that the shaft 18 of the accessory storage device 10 may be disconnected from the retainer 17 and functionally used as a securing mechanism to gather and secure a lock of hair into a pony tail or the like. Accordingly, the shaft 81 may constructed as a flexible member so that it may be bent to curve around a lock of hair as shown in FIG. 25. Likewise, the shaft 81 may include a resilient rigid element 84 adapted to allow the shaft 81 to bend into a preferred orientation capable of securing the hair when used as the securing mechanism. As shown, the shaft 81 is constructed as a flexible element and disconnected from the container 12 and bent into a preferred configuration. The shaft 81 is bent and secures a lock of hair into a pony tail 83, a bun, or the like. In storage, the shaft 18 can be re-straightened and re-connected to the retainer 17 and stored for later use.

Figure 26:
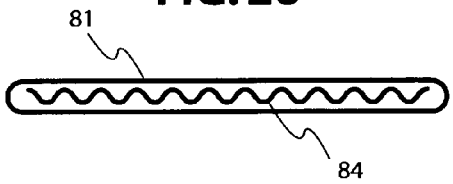
FIG. 26 illustrates the exemplary shaft in accordance with this invention.

FIG. 26 illustrates the flexible shaft 81 in accordance with this invention. As shown, the flexible shaft 81 may include a sturdy flexible and/or spring biased element 84 disposed within the shaft 81 so as to provide the resilient rigidity to bend over a lock of hair and secure it in place. Various types of inner flexible, yet rigid members 84 may be integrated to provide suitable support to the pony tail 83 and prevent it from unraveling.

Figure 27:
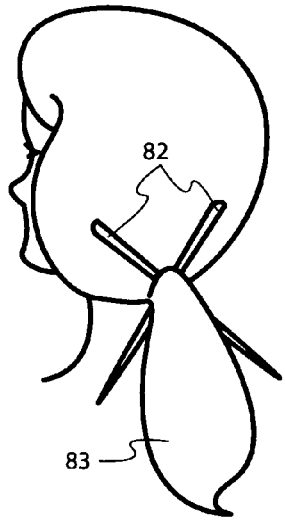
FIG. 27 illustrates another exemplary use for a pair of shafts in accordance with this invention.

FIG. 27 illustrates another exemplary use for a pair of shafts 82 in accordance with this invention. In FIG. 27, a pair of shafts 82 are removed from the retainer 17 in the container 12 and arranged to secure a lock of hair in a pony tail 83 fashion by using them as a pair of shafts 82 as hair picks.

Figure 28:
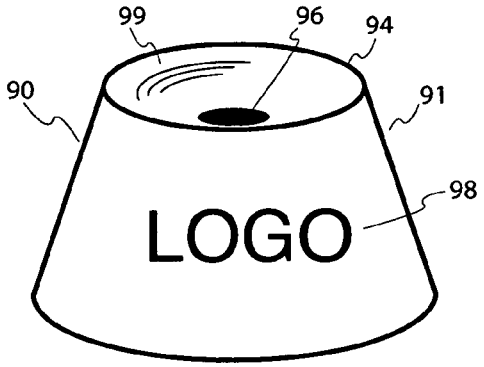
FIG. 28 shows an exemplary stand for receiving a shaft of the accessory storage device in accordance with this invention.
Figure 30:
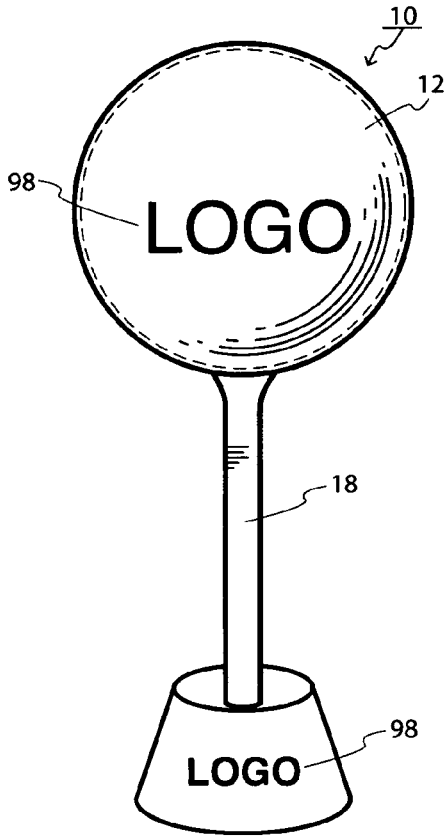
FIG. 30 illustrates the shaft of the accessory storage device placed in an aperture of the stand in accordance with this invention.

FIG. 28 depicts an exemplary stand 90 for receiving a shaft 18 of the accessory storage device 10 in accordance with this invention, and as shown in FIG. 30. As shown, the stand 90 is conical in shape having conical side walls 91 bounded by a wider flat base 92 and a narrower top 94.

Figure 29:
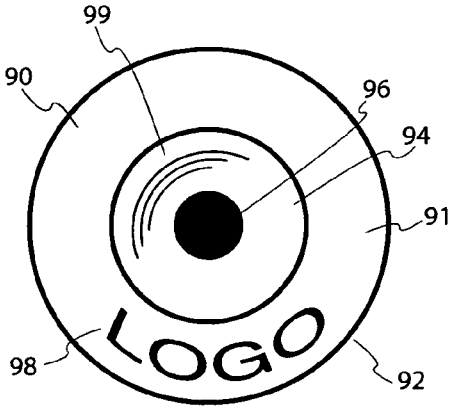
FIG. 29 is a top view of the stand in accordance with this invention.

FIG. 29 is a top view of the stand 90. As shown from the top view, and FIG. 28, a recessed central aperture 96 is recessed within the stand 90 adapted to receive the end of the shaft 18. As shown, the central aperture 96 is disposed within a concave shape 99 portion of top 94 of the stand 90. The end of the shaft 18 may be secured in a variety of different ways, such as by a friction fit, a threaded fastener connection fit, and/or any other mechanism for securing the shaft 18 to the stand 90 in accordance with this invention.

FIG. 30 demonstrates the shaft 18 of the accessory storage device 10 placed into the recessed central aperture 96 of the stand 90. As shown, the construction of the elongated wider flat base 92 is optimally designed to securely balance the center of gravity of the accessory storage device 10 within the base 92 in an upright position which prevents the accessory storage device 10 from easily toppling over. However, it is to be understood that the stand 90 may be configured in a variety of different constructions, such as the base 92 and the top 94 being the same size and/or inverted in size. Likewise, the shape and size of the base may take any shape suitable for balancing the accessory storage device 10 in an upright position.

Figure 31:
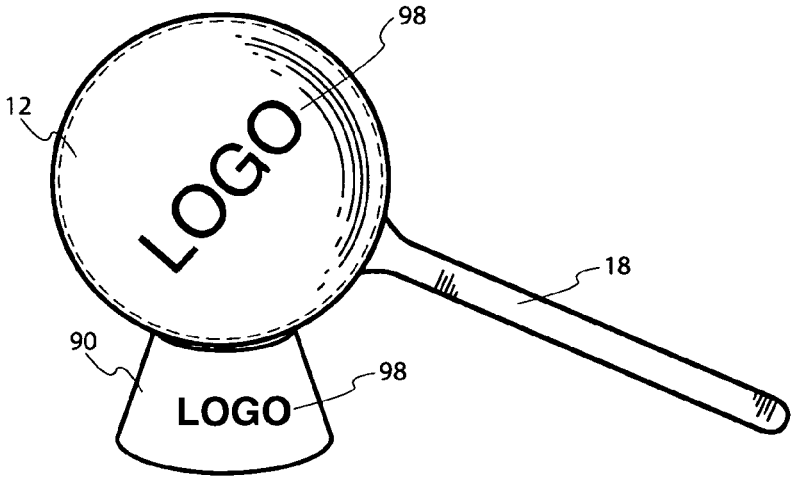
FIG. 31 depicts another illustration in which the stand may support the accessory storage device in accordance with this invention.

FIG. 31 depicts an alternative illustration in which the accessory storage device 10 is supported by the stand 90. As shown, the concave shape 99 of the top 94 is contoured to substantially fit to the outer curved shape of the container 12 of the accessory storage device 10. At rest, the outer curved shape of the container 12 rests on top of the concave shape 99 portion of the top 94. The concave shape 99 portion of the top 94 holds and/or cradles the container 12 in a preferred position and prevents the container 12 from rolling off of the stand 90 in this position.

The accessory storage device 10 and/or the stand 90 may be adapted for commercial use with various displays, such as but not limited to, a hanging display, a display column, a fixed carousel, a rotatable display unit, a vanity and/or any other type of commercial display. Although the figures illustrate bow clip type accessories, it is to be understood that various fashion accessory boutiques items may be implemented in accordance with this invention.

As shown in FIGS. 28-31, to further enhance the appearance of the accessory storage device 10 and the stand 90, various types of indicia 98 and/or other decorative material may be printed on to the accessory storage device 10 and the stand 90, such as a trademark designs, a logo, an artistic expression, a brand, a mascot, and/or any type of design or printed indicia. Likewise, the accessory container device 10 and the stand 90 may be configured in any number of sizes, colors and shapes in accordance with this invention.

The accessory container device 10 and stand 90 may be made from a variety of different material compositions. For example, the container 12 and/or stand 90 may be made from a polymer, glass, metal, and or any other transparent, opaque and/or other material there-between suitable for securely encasing an accessory within the container 12. Likewise, the shafts 18, 81, 82 may be constructed as a rigid rod and/or as a flexible rod for additional applications as described with respect to FIGS. 25-27. The panel 60 may also be constructed as a rigid or flexible, yet durable material capable of providing sufficient structure to prop the various accessories in a preferred position within the container.

This invention may be made of common materials which are available and may integrate an infinite variety of colors and printed media thereon. The construction of the accessory container device 10 and the stand 90 is economical to manufacture because the cost of materials is low, and construction is simple. The accessory container device 10 and the stand 90 may be molded in a variety of different ways commercially known, and/or discovered later in accordance with this invention.

Many variations of the present invention will suggest themselves to those skilled in the art in light of the above detailed description and accompanying drawings. It will be recognized by those skilled in the art that changes or modifications may be made to the above described embodiments without departing from the broad inventive concepts of the invention. It is understood therefore that the invention is not limited to the particular embodiments which are described, but is intended to cover all modifications and changes within the scope and spirit of the invention.

What is claimed is:

1. A decorative accessory storage device comprising:

a container having a first container portion and a second container portion connected together at a closing edge defining an encapsulated volume therein;

a shaft having a first end and a second end, the first end of the shaft including an inner female threaded portion adapted to receive a male threaded portion extending from, and attached to the container;

a panel including perforations through which a fastener of an accessory may be attached to arrange the accessory within the encapsulated volume of the container in a predetermined position; and a conical stand having an angular concentric side wall bounded by a wider flat base and a narrow top, the narrow top having a recessed aperture adapted to receive the second end of the shaft so that the container is secured in an upright position.

2. The decorative accessory storage device as recited in claim 1, wherein:

the closing edge of the first container portion includes an outer ridge defined at the end of an inner male concentric flange, and the closing edge of the second container portion includes an inner ridge defined at a base of an outer female concentric flange, such that when the container is in a closed position, the outer ridge of the first container portion lies adjacent to, and concentric over the inner ridge of the second container portion.

3. The decorative accessory storage device as recited in claim 1, wherein the at least one accessory is selected from at least one of: a hair bow, jewelry, a beret, a head band, and a hair band.

4. The decorative accessory storage device as recited in claim 1, wherein the male threaded portion further comprises:

a first male threaded portion attached to the first container portion; and a second male threaded portion attached to the second container portion, wherein the first male threaded portion and the second male threaded portion are aligned, and combined, to form the male threaded portion that is received by the inner female threaded portion.

5. The decorative accessory storage device as recited in claim 1, wherein the first container portion and the second container portion are connected with a hinge.

6. The decorative accessory storage device as recited in claim 1, wherein more than one decorative accessory storage device can be secured to each other in a bouquet arrangement.

7. The decorative accessory storage device as recited in claim 1, wherein the shaft is a flexible shaft and is adapted for use as a hair band.

8. The decorative accessory storage device as recited in claim 1, wherein the top of the stand has a concave shape contoured to substantially fit to an outer curved shape of the container such that the concave shape cradles the container in a preferred position and prevents the container from sliding off of the stand.

* * * * *